US006499616B2

(12) United States Patent
Verderber

(10) Patent No.: US 6,499,616 B2
(45) **Date of Patent: *Dec. 31, 2002**

(54) CAP WITH ANGLED UPPER SKIRT

(75) Inventor: Rudolph R. Verderber, San Jose, CA (US)

(73) Assignee: Portola Packaging, Inc., San Jose, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/903,682

(22) Filed: Jul. 10, 2001

(65) Prior Publication Data

US 2001/0037989 A1 Nov. 8, 2001

Related U.S. Application Data

(63) Continuation of application No. 09/186,406, filed on Nov. 4, 1998, now abandoned.

(51) Int. Cl.[7] ..... B65D 39/00
(52) U.S. Cl. ..... 215/254; 215/256
(58) Field of Search ..... 215/317, 320, 215/321, 344, 254, 256; 220/780

(56) References Cited

U.S. PATENT DOCUMENTS

| | | | |
|---|---|---|---|
| 3,209,934 | A | 10/1965 | Salminen |
| 3,254,785 | A | 6/1966 | Lovell |
| 3,392,860 | A | 7/1968 | Faulstich |
| 3,392,862 | A | 7/1968 | Faulstich |
| 3,589,543 | A | 6/1971 | Weigand |
| 3,840,137 | A | 10/1974 | Faulstich |
| 3,979,002 | A | 9/1976 | Faulstich |
| 4,071,156 | A | 1/1978 | Lowe |
| 4,078,696 | A | 3/1978 | Crisci |
| 4,417,666 | A | 11/1983 | Roberts |
| 4,531,650 | A | 7/1985 | Friendship |
| 4,660,735 | A | 4/1987 | Peschardt et al. |
| 4,815,620 | A | 3/1989 | Bullock, III |
| 4,828,128 | A | 5/1989 | Tackles |
| 4,884,707 | A | 12/1989 | Crisci |
| 4,911,316 | A | 3/1990 | Tackles |
| 5,121,846 | A | 6/1992 | Adams et al. |
| 5,224,616 | A | 7/1993 | Crisci |
| 5,232,125 | A | 8/1993 | Adams |
| 5,284,265 | A | 2/1994 | Crisci |
| 5,370,270 | A | 12/1994 | Adams et al. |
| 5,460,283 | A | 10/1995 | MaCartney et al. |
| 5,513,763 | A | 5/1996 | Adams et al. |
| 5,630,520 | A | 5/1997 | Luch et al. |
| 5,662,231 | A | 9/1997 | Adams et al. |
| 5,687,865 | A | 11/1997 | Adams et al. |
| 5,868,281 | A | 2/1999 | Bietzer et al. |
| 5,909,827 | A | 6/1999 | Bietzer et al. |
| 5,911,334 | A | 6/1999 | Helms |
| 5,975,320 | A | 11/1999 | Bietzer et al. |
| 6,082,567 | A | 7/2000 | Bietzer et al. |
| 6,102,226 | A | 8/2000 | Verderber |
| 6,177,041 | B1 | 1/2001 | Bietzer |

*Primary Examiner*—Stephen K. Cronin
(74) *Attorney, Agent, or Firm*—Dorsey & Whitney LLP

(57) ABSTRACT

A bottle cap (10) having a top panel (12) and a downwardly depending skirt (14). Skirt (14) includes an angled upper portion (20) and a generally cylindrical lower portion (22) with an exterior bead (24) thereon. Angled upper skirt portion (20) extends from a perimeter bead (23) down to a locking bead (34), which allows upper skirt (20) to transfer an application force from perimeter bead (23) radially to locking bead (34) in order to push the locking bead down around the upper crown (42) of a bottle neck (40).

9 Claims, 4 Drawing Sheets

CAP WITH ANGLED UPPER SKIRT

This is a Continuation of U.S. patent application No. 09/186,406, filed Nov. 4, 1998, now abandoned.

TECHNICAL FIELD

The present invention relates to caps for water bottles and similar containers of various sizes and, more particularly, to an improved upper cap design for simplifying application of the cap onto a bottle neck.

BACKGROUND ART

Current designs for five gallon water bottle closures or caps include a seal bead on the under side of the cap and above a locking bead that biases the seal bead down against the crown of the bottle neck to tightly seal the cap around the crown. The locking bead snaps down and around the upper crown of the bottle neck to concentrate the lower load onto the upper side of the crown and onto a smaller surface region, which raises the surface pressure on the cap and thereby improves the seal. Some caps are provided with foam on the under side of the top panel of the cap, because the foam conforms to irregularities in the crown surface and as a result enhances the effectiveness of the seal.

U.S. Pat. No. 3,979,002 of Faulstich discloses a water bottle cap with no seal bead and which is intended to thread onto a bottle neck. The upper region of the cap has an outwardly angled, somewhat conical shape defined at its lower edge by an external bead that fits around an external upper thread located above the crown. U.S. Pat. No. 3,392,860 also of Faulstich discloses a similar cap design. The design of the upper cap region of the present invention improves upon the cap designs shown in these patents.

Various designs for bottle caps are shown in U.S. Pat. Nos. 3,392,862 and 3,840,137 of Faulstich, and 4,884,707 of Crisci, which disclose seal bead designs where the seal bead is located beneath the crown of the bottle neck, which requires the seal bead to be completely pushed down beneath the crown. U.S. Pat. Nos. 4,911,316 of Tackles, 5,121,846 of Adams et al., and 5,232,125 of Adams disclose designs where the seal bead engages the top surface of the crown. With these three later designs, the seal bead is generally aligned with the locking bead and, to some extent, increases the frictional resistance generated when pushing the locking bead down over the crown. All of the foregoing patents provide general background information on the state of the art for cap designs.

DISCLOSURE OF INVENTION

Briefly described, the improved closure of the present invention includes a top panel for closing off a container neck opening and a skirt depending from the top panel for covering upper side portions of the container neck. A locking bead extends inwardly from the interior side of the skirt at a location spaced from the top panel. The locking bead is adapted to mount underneath the upper crown upon full mounting of the closure on the container neck. The upper portion of the skirt from the locking bead to the top panel is angled inwardly, to direct at least a portion of the application force radially outwardly to assist the locking bead in clearing the upper crown.

According to an aspect of the invention, the locking bead is positioned radially outwardly of the perimeter bead. The upper skirt portion can take on any of a variety of shapes, but preferably is angled in order to efficiently direct the application force to the locking bead. Preferably, the angled upper portion of the skirt is frustoconical.

According to this aspect of the invention, the upper portion of the skirt directs at least a portion of the application force along a path directly outwardly of the upper crown. This assists in pushing the locking bead down around the upper crown of the container neck. The stiffness of the frustoconical upper cap decreases as the angle from vertical increases. An optimum angle can be determined where sufficient stiffness and radially directed force are both achieved.

According to another aspect of the invention, the top panel includes a raised perimeter bead adjacent the periphery of the top panel for receiving an application force to mount the closure onto the neck.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
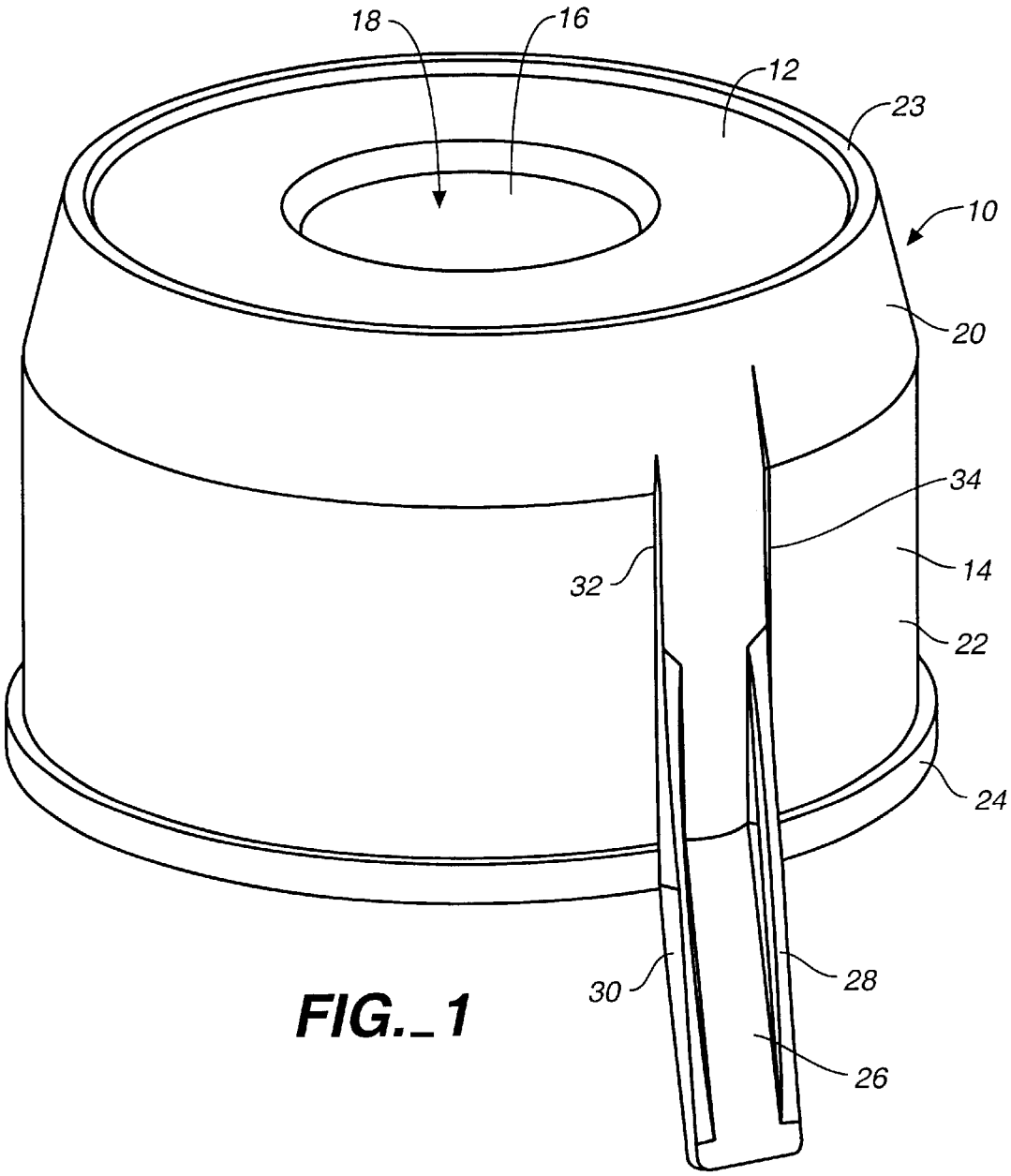
FIG. 1 is a pictorial view of the bottle cap of the present invention.

Referring to FIG. 1, the bottle cap 10 of the present invention includes an annular top panel 12 and a cylindrical downwardly depending outer skirt 14. Bottle cap 10 is illustrated as a non-spill cap including a concentric inner skirt 16 forming an opening 18 at the center of the cap. Opening 18 is provided to receive a probe or feed tube of a dispensing unit in a manner that dislodges a plug that is removably mounted at the bottom of inner skirt 16. Non-spill caps and their basic design and operation are well known in the art. However, the present invention is not meant to be limited to non-spill caps and, in fact, the present invention works quite well with any type of generally cylindrical cap, including conventional tear-away caps.

Outer skirt 14 includes an inwardly angled upper portion 20 and a more upright, generally cylindrical lower portion 22. Lower skirt portion 22 is provided as a protective cover for sanitary reasons to prevent dirt and debris from accumulating on the neck region of the bottle. At the upper edge of angled skirt portion 20 is provided a raised perimeter bead 23 that defines an area for applying a stick-on label over opening 18. Raised perimeter bead 23 also provides a point of application for an applicator to press cap 10 onto a bottle neck.

At the bottom edge of lower skirt 22 is provided an annular exterior bead 24 that extends around the lower peripheral edge of skirt 14. As discussed in more detail later, exterior bead 24 provides added rigidity at the lower portion of skirt 14 in order to prevent ovalization.

Cap 10 also includes a downwardly extending pull tab 26. Pull tab 26 includes a pair of side stiffening ribs 28, 30 and has a slight outward cant, formed during formation of the cap, which prevents the tab from interfering in mounting of cap 10 onto the neck of a container. Also, a pair of reduced thickness tear lines 32, 34 are provided, extending from the sides of pull tab 26 up into upper skirt 20. Tear line 34 extends farther up into angled upper skirt than does tear line 32. Tab 26 is provided in order to remove cap 10, either to mount the bottle onto a conventional dispenser that does not include a non-spill feature or to refill the bottle after the contents of the bottle have been dispensed.

Figure 2:
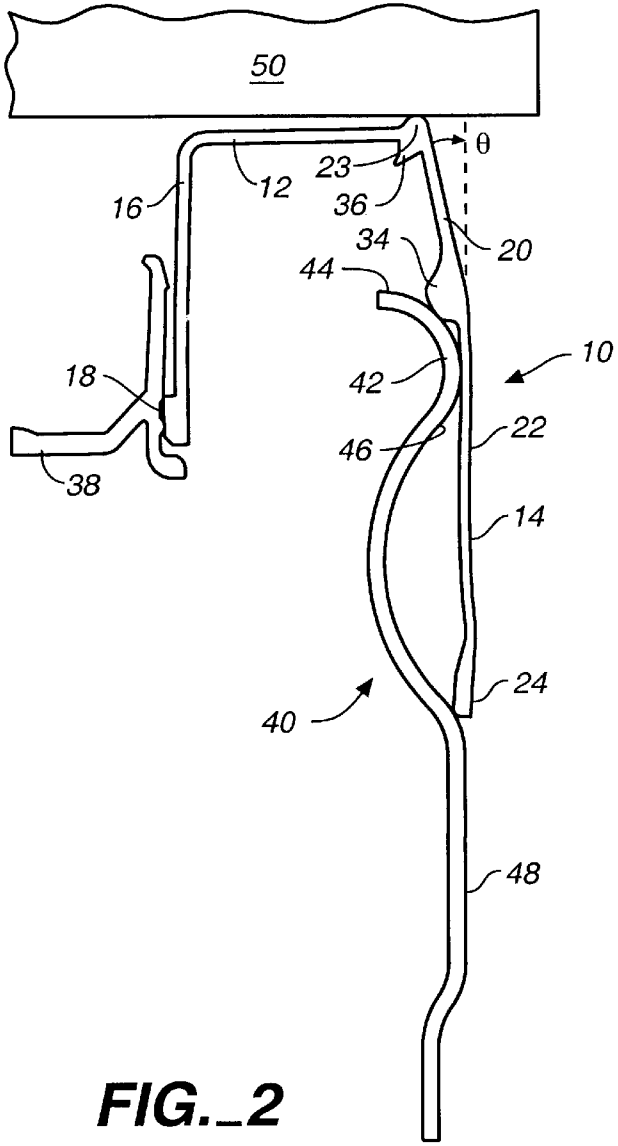
FIG. 2 is a partial sectional view of the cap of FIG. 1 and a bottle neck shown with the cap in position over the bottle neck and an applicator in position to press the cap onto the neck.

Referring to FIG. 2, cap 10 further includes an internal annular locking bead 34 that extends around the interior wall of skirt 14 at the junction of angled upper skirt portion 20 and lower skirt portion 22. The preferable design of locking bead 20 is disclosed in co-pending application Ser. No. 09/169,220, entitled "Internal Locking Bead Design for Bottle Cap," however, the present invention is not limited to a particular locking bead design. It is sufficient that the locking bead perform its function of securing the cap to the bottle.

Bottle cap 10 further includes an annular seal bead 36 that projects inwardly and downwardly and is formed at the junction of angled upper skirt 20 and the outer edge of top panel 12. Also shown in FIG. 2 is half of a plug 38 that mounts within inner skirt 16 to close opening 18. Plug 38 is provided for non-spill caps, which are becoming more widely used in the bottled water industry. For a conventional tear-away cap, plug 38 is not required and inner skirt 16 is eliminated so that top panel 12 comprises a flat circular disc that forms the top portion of the cap and which functions to close and seal the neck opening of a bottle.

In FIG. 2, a portion of a bottle neck 40 is shown. Bottle neck 40 includes an upper crown 42 having an upper side 44 and an underside 46. Bottle neck 40 also includes a lower wide diameter section 48. The lower portion 22 of skirt 14 is designed to extend down around section 48 and form a protective covering for the upper regions of the neck, although this feature is not necessary to the invention. In addition, the particular design of the bottle neck is not essential to the present invention so long as the bottle neck includes a crown or similar wide diameter bead or projection that is designed to receive a locking bead for securing the cap on the neck.

While angled upper skirt 20 of skirt 14 is shown as a frustoconical shape, it is not necessary that the upper skirt 20 take the shape of a frustoconical cone. It is preferable, however, that locking bead 34 be positioned radially outwardly of perimeter bead 23. This creates a radially outwardly directed component of an application force, as discussed with reference to FIGS. 3–6. Angled upper skirt 20 extends from top panel 12 down to locking bead 34 and in this manner assists in directing the application force from perimeter bead 23 to the locking bead 34, as discussed later.

Figure 3:
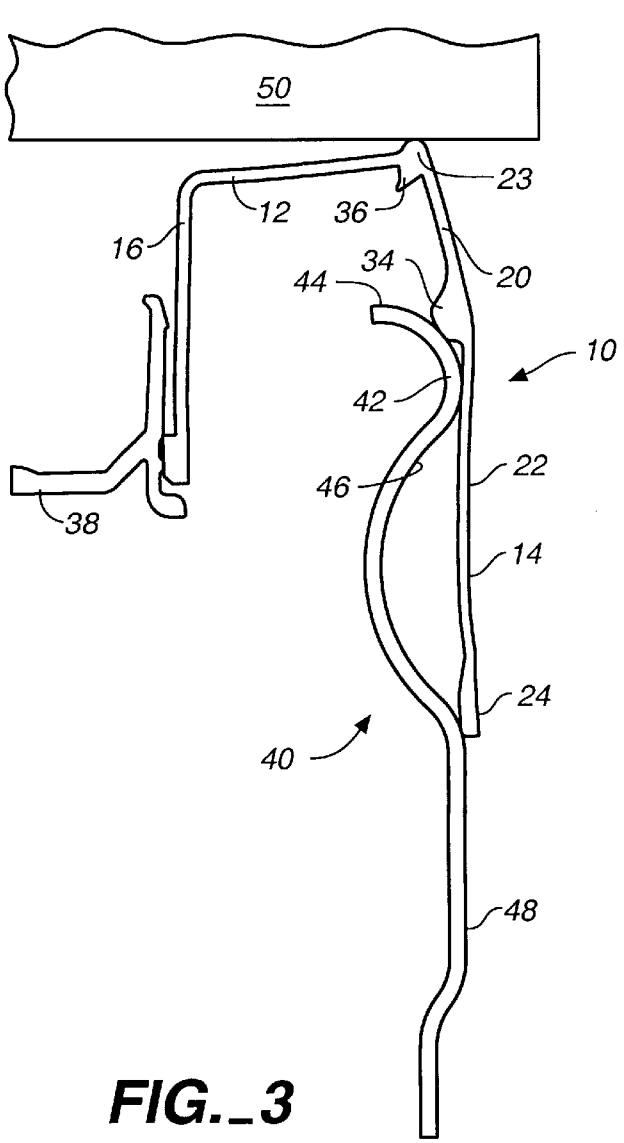
FIG. 3 is a sectional view like FIG. 2, showing the cap being pushed onto the bottle neck.

In FIG. 2, cap 10 is positioned on bottle neck 40 with locking bead 34 against upper side 44 of crown 42. An applicator 50 engages perimeter bead 23 and begins pushing cap 10 onto neck 40. As shown in FIG. 3, applicator 50 has pushed cap 10 downwardly onto bottle neck 40 to the point where locking bead 34 has moved slightly radially outwardly and down the side of upper side 44. The resistance of locking bead 34 against upper crown 42 causes top panel 12 and inner skirt 16 to bend inwardly and downwardly.

Figure 4:
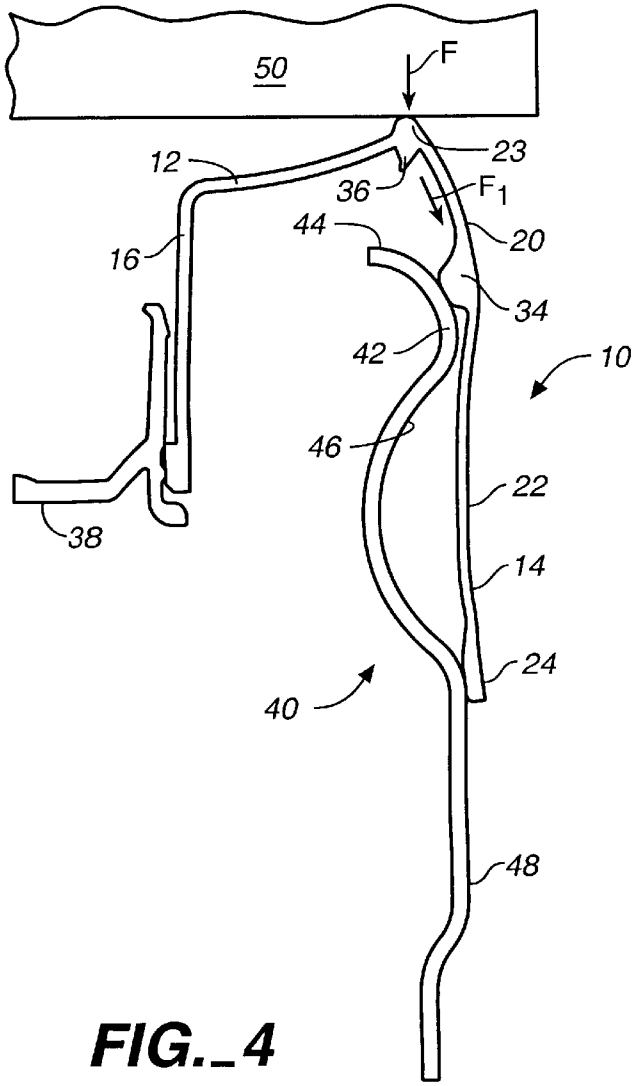
FIG. 4 is a sectional view like FIGS. 2 and 3, showing the locking bead moving down around the upper crown of the bottle.

Referring to FIG. 4, as applicator 50 further presses cap 10 onto bottle neck 40, locking bead 34 moves down toward the outer diameter of upper crown 42, which further increases the resistance created by locking bead 34 and crown 42. With increased resistance, top panel 12 and inner skirt 16 bend further down into the bottle neck opening.

An advantage of the present invention is the design of upper angled skirt portion 20. As the resistance created by locking bead 34 increases, the angled design of upper skirt 20 transfers the application force, shown by arrow F, down through upper skirt 20 and at least partially radially outwardly, as shown by arrow $F_1$. The radial component of force $F_1$ assists in pushing locking bead 34 down around upper crown 42 and the angle of upper skirt 20 creates this radial force component.

Figure 5:
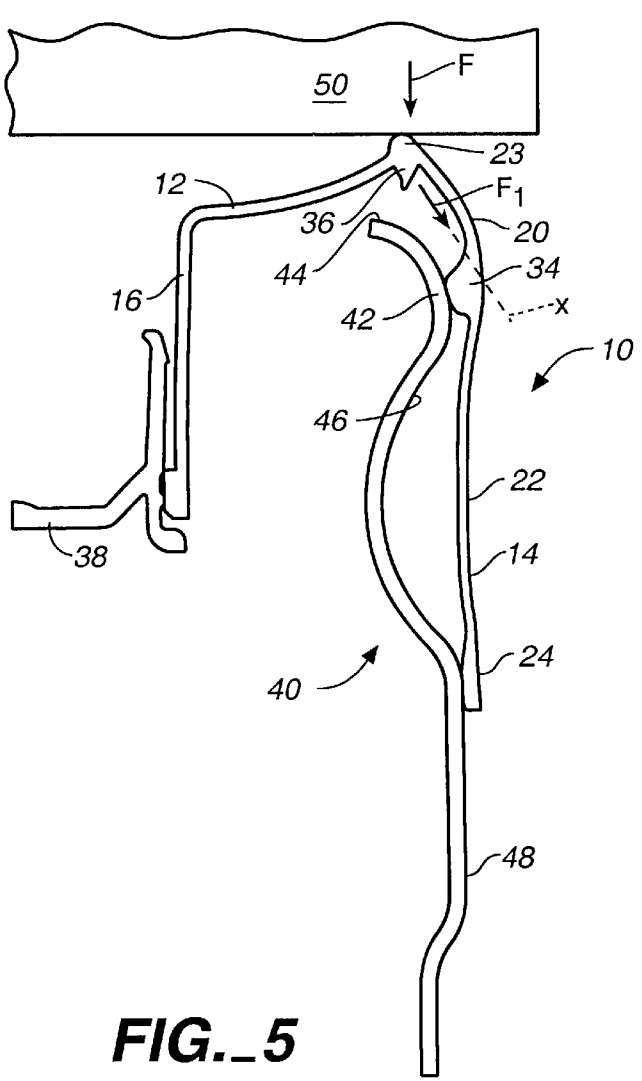
FIG. 5 is a sectional view like FIGS. 2–4, showing the locking bead near its maximum point of clearance.

Referring to FIG. 5, locking bead 34 is pushed outwardly near the maximum clearance at the outside diameter of upper crown 42. At this point, upper skirt 20 begins to bend slightly due to the resistance created by locking bead 34 and upper crown 42. The radial component of force $F_1$ increases as the bending of upper skirt 20 increases, which further assists in pushing locking bead 34 down around upper crown 42. An important feature of upper skirt 20 is its extension from perimeter bead 23 down to locking bead 34 and along a path x directed outwardly of upper crown 42. As a result, force $F_1$ is directed in a manner that assists in pushing locking bead 34 outwardly around upper crown 42.

Figure 7:
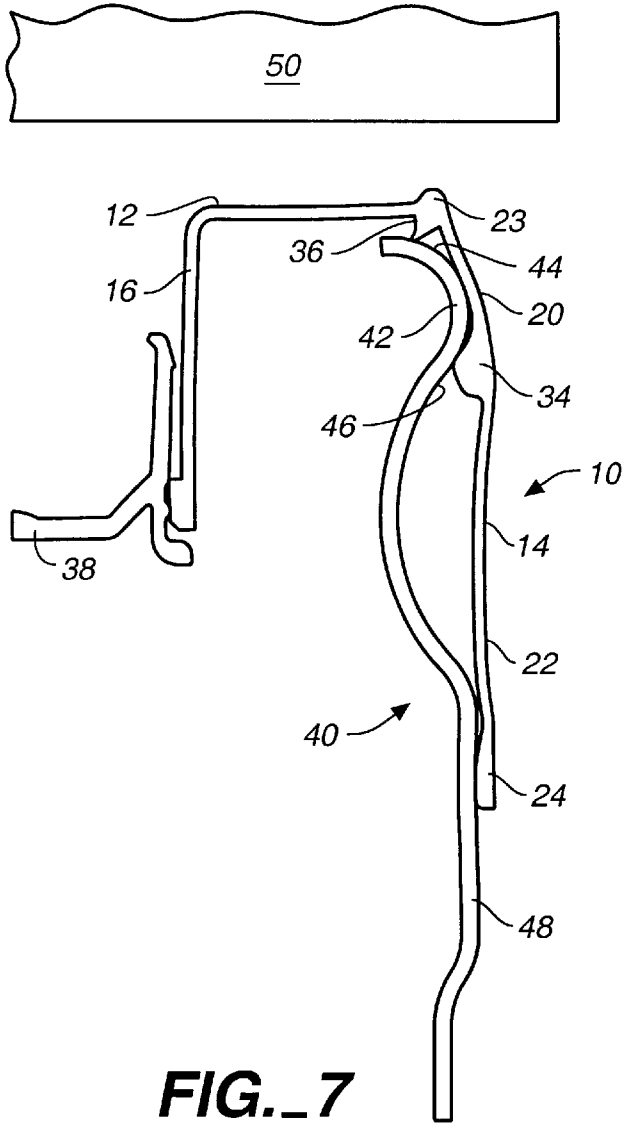
FIG. 7 is a sectional view like FIGS. 2–6, showing the applicator retracted away from the cap.
Figure 6:
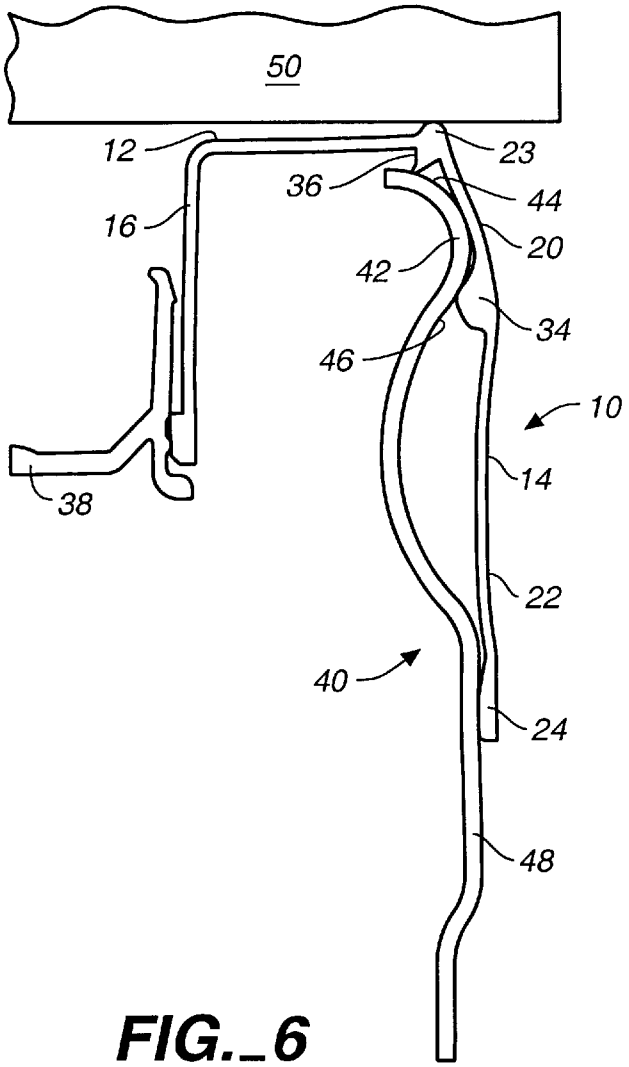
FIG. 6 is a sectional view like FIGS. 2–5, showing the locking bead fully seated past the upper crown and the seal bead pressed against the upper rim of the crown.

Referring to FIG. 6, locking bead 34 has moved down past the maximum point for clearance of upper crown 42 and is engaged against the underside 46 of upper crown 42. Lower skirt 22 covers the upper section of bottle neck 40 and exterior bead 24 is engaged against wide neck section 48. Seal bead 36 is pressed down against upper side 44 of crown 42 and is biased thereagainst by locking bead 34. In this position, cap 10 is securely positioned onto bottle neck 40. As shown in FIG. 7, applicator 50 is retracted and the cap mounting procedure is complete.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto when read and interpreted according to accepted legal principles such as the doctrine of equivalents and reversal of parts.

The invention claimed is:

1. A closure for a container of the type having a rounded neck with an upper crown defining a neck opening, comprising:

a top panel for closing off the neck opening, a skirt depending from the top panel for covering upper side portions of the neck, and a locking bead extending inwardly from the interior side of the skirt at a location spaced from the top panel, the locking bead adapted to mount underneath the upper crown upon full mounting of the closure on the neck, a cylindrical lower portion of the skirt extending below the locking bead, wherein the upper portion of the skirt from the locking bead to the top panel is substantially straight and angled inwardly, to direct at least a portion of the application force radially outwardly to assist the locking bead in clearing the upper crown, and wherein the skirt includes a pair of tear lines that extend up into the upper portion of the skirt.

2. The closure of claim 1 wherein, the top panel further includes a raised perimeter bead for directing an application force to the skirt.

3. The closure of claim 1 wherein, the closure includes a non-spill central opening and removable plug.

4. In combination, the closure of claim 1 and a container having a container neck wherein, the skirt of the closure includes a lower edge having an exterior bead, and wherein the skirt being dimensioned to position the lower edge of the skirt against the container neck.

5. The combination of claim 4 wherein, the container neck includes a crowned upper portion and a wide diameter lower portion, and the skirt being dimensioned to position the lower edge of the skirt against the wide diameter lower portion of the container neck.

6. The closure of claim 1 wherein, the top panel includes a raised perimeter bead adjacent the periphery of the top panel for receiving an application force to mount the closure onto the neck.

7. The closure of claim 6 wherein, the locking bead is positioned radially outwardly of the perimeter bead.

8. The closure of claim 7 wherein, the angled upper portion of the skirt is frustoconical having inside and outside surfaces that are at an angle.

9. The closure of claim 7 wherein, the upper portion of the skirt directs at least a portion of the application force along a path directly outwardly of the upper crown.

* * * * *